US005643547A

United States Patent [19]

Yamada et al.

[11] Patent Number: 5,643,547

[45] Date of Patent: Jul. 1, 1997

[54] PROCESS FOR PRODUCING CARBON FIBERS

[75] Inventors: Tetsuo Yamada; Tomiji Hosotsubo, both of Kashima-gun, Japan

[73] Assignee: Petoca, Ltd., Tokyo, Japan

[21] Appl. No.: 373,457

[22] Filed: Jan. 17, 1995

Related U.S. Application Data

[63] Continuation of Ser. No. 201,006, Feb. 24, 1994, abandoned.

[30] Foreign Application Priority Data

Feb. 24, 1993 [JP] Japan ..... 5-057977

[51] Int. Cl.$^6$ ..... D01F 9/15

[52] U.S. Cl. ..... 423/447.4; 423/447.6

[58] Field of Search ..... 423/447.4, 447.6, 423/447.7; 264/29.6

[56] References Cited

U.S. PATENT DOCUMENTS 4,788,050 11/1988 Hirose et al. ..... 423/447.4

FOREIGN PATENT DOCUMENTS

| | | |
|---|---|---|
| 1594982 | 5/1969 | Germany . |
| 3701631A1 | 7/1987 | Germany . |
| 47-33020 | 8/1972 | Japan . |
| 48-42696 | 12/1973 | Japan . |
| 49-118917 | 11/1974 | Japan . |
| 59-30915 | 2/1984 | Japan . |
| 60-259629 | 5/1984 | Japan . |
| 60-231825 | 11/1985 | Japan . |
| 61-502772 | 11/1986 | Japan . |
| 2-242919 | 9/1990 | Japan . |
| 4-24445 | 4/1992 | Japan . |

*Primary Examiner*—Steven Bos
*Assistant Examiner*—Stuart L. Hendrickson
*Attorney, Agent, or Firm*—Oblon, Spivak, McClelland, Maier & Neustadt, P.C.

[57] ABSTRACT

A process for preparing mesophase pitch based carbon fibers is disclosed, wherein mesophase pitch fibers are gas-phase nitrated in an atmosphere of an oxygen-containing gas such as air or an inert gas such as nitrogen containing 0.1 to 50% by volume of $NO_2$ at a low temperature of not higher than 100° C. for a long period of time. The carbon fibers thus obtained are excellent in both mechanical strength and elastic modulus and have well-balanced physical properties.

2 Claims, No Drawings

PROCESS FOR PRODUCING CARBON FIBERS

This application is a continuation of application Ser. No. 08/201,006, filed Feb. 24, 1994, now abandoned.

FIELD OF THE INVENTION

The present invention relates to an improvement in a process for producing carbon fibers from a mesophase pitch.

More particularly, the invention relates to an improvement in a process for producing carbon fibers from a mesophase pitch, which includes a stage of gas-phase nitrating pitch fibers with a $NO_2$ gas at a low temperature of not higher than 100° C. to infusibilize the pitch fibers.

BACKGROUND OF THE INVENTION

Pitch based carbon fibers have been conventionally obtained by a process comprising the steps of spinning a pitch into pitch fibers, air-oxidizing the pitch fibers at a reaction temperature of from about 200° to 400° C. in air to prepare infusibilized pitch fibers, and then heat-treating the infusibilized pitch fibers at a high temperature to carbonize and/or graphitize them.

However, because such infusibilization reaction by means of the air-oxidation as described above never proceeds when the reaction temperature is lower than 150° C., the air-oxidation must be carried out at a high temperature.

For this reason, infusibilization techniques utilizing liquid-phase oxidation effective even at a low temperature have been developed. In these techniques, however, there is involved such a problem that the surface layer portions of the fibers are excessively oxidized to thereby readily bring about lowering of the mechanical property of the carbon fibers obtained from a pitch (see: Japanese Patent Laid-Open Publications No. 118917/1974, No. 30915/1984, No. 231825/1985, No. 502772/1986, No. 242919/1990, etc).

Japanese Patent Publication No. 42696/1973 describes a method of infusibilizing pitch fibers obtained from a specific pitch, e.g., pitch material containing high aromatic content or hydrogenation product thereof, at a temperature of not lower than about 110° C. in a nitrogen oxide-containing oxidizing gas atmosphere. However, this method can be applied only to the above-mentioned specific pitch material, and any possibility of an application to such a mesophase (optically anisotropic) pitch as used in the invention is not suggested at all.

Further, in the above-mentioned Japanese Patent Publication No. 42696/1973, such a technical idea that the mesophase pitch fibers are completely infusibilized by only treating them with $NO_2$ at a low temperature is never illustrated, though the treatment with $NO_2$ at a low temperature described in this publication is significant as a pretreatment for the infusibilization of the pitch fibers with air.

Japanese Patent Publication No. 12740/1976 discloses a method of infusibilizing pitch fibers obtained from a fiber-forming pitch such as a petroleum pitch in a $NO_2$-containing oxidizing gas at a temperature of from 100° to 350° C. In more detail, however, according to its examples, only disclosed in this publication is a method in which pitch fibers are infusibilized at a temperature of from 100° to 300° C. over a period of 2.5 hours in two stages in combination with a treatment with ammonia, and this publication does not give any suggestion on a method of infusibilizing such mesophase (optically anisotropic) pitch fibers as used in the present invention over a long period of time at a low temperature of not higher than 100° C. through all the process.

Japanese Patent Publication No. 24445/1992 discloses a method of infusibilizing mesophase (optically anisotropic) pitch fibers or optically isotropic pitch fibers in an oxidizing gas atmosphere containing 0.1 to 50% by volume of $NO_2$ at a high temperature of from 150° to 380° C.

Namely, in the example of the publication the infusibilization treatment is carried out at a relatively high temperature such as 270° to 300° C. for a short period of time such as 24 to 30 minutes in a gas phase at a $NO_2$ concentration of 2 to 5% by volume.

With respect to the infusibilization by a conventional gas-phase oxidation using air only, it is well known that the oxidation reaction does not proceed at all when the temperature is lower than 150° C.

As described above, a method of infusibilizing a mesophase pitch under a $NO_2$-containing air is also known, however, the prior art teaches or suggests that the infusibilization of the mesophase pitch fibers by an oxidation reaction under the $NO_2$-containing air is not sufficiently attained, unless the infusibilization is conducted at a high temperature of not lower than 150° C. The prior art also teaches that the infusibilization of a starting pitch under a $NO_2$-containing air at a temperature of lower than 110° C. can be attained only when the specific starting pitch containing high aromatic content is used.

If the pitch fibers obtained from a mesophase (optically anisotropic) pitch are infusibilized at a high temperature, e.g., 150° C., the oxidation reaction of the pitch fibers rapidly proceeds, and as a result, the pitch fibers are liable to be excessively oxidized or heterogeneously infusibilized, thereby the resultant carbon fibers do not always have homogeneous and well-balanced physical properties.

OBJECT OF THE INVENTION

The present inventors have studied variously on the above-mentioned problems, and as a result, they have found that when mesophase pitch fibers are gas-phase nitrated at a low temperature of not higher than 100° C. in an oxygen-containing gas such as air or an inert gas such as nitrogen, which contains a specific amount of $NO_2$, the mesophase pitch fibers can be uniformly infusibilized to obtain carbon fibers which are excellent in both mechanical strength and elastic modulus and have well-balanced physical properties. Thus, the present invention has been accomplished.

SUMMARY OF THE INVENTION

The process for producing carbon fibers according to the present invention comprises melt-spinning a starting pitch comprising as its major component a mesophase pitch in accordance with a conventional manner to obtain mesophase pitch fibers, thereafter gas-phase nitrating the pitch fibers thus obtained in an atmosphere of an oxygen-containing gas or an inert gas containing 0.1 to 50% by volume of $NO_2$ and at a temperature of not higher than 100° C. to infusibilize the pitch fibers, and then carbonizing and/or graphitizing the infusibilized pitch fibers in a conventional manner.

In the present invention, the above-mentioned infusibilization reaction is preferably carried out at a reaction temperature of from room temperature to 100° C. for a period of not shorter than 2 hours.

DETAILED DESCRIPTION OF THE INVENTION

The present invention will be described below in detail.

In the process for producing carbon fibers from a mesophase pitch according to the invention;

(a) a starting pitch comprising as major component a mesophase pitch is melt-spun in accordance with a conventional manner to prepare pitch fibers; and (b) the pitch fibers are gas-phase nitrated in an oxygen-containing gas (e.g., air) or an inert gas (e.g., nitrogen)

containing 0.1 to 50% by volume of $NO_2$ at a low temperature of not higher than 100° C. to infusibilize the pitch fibers.

In conventional processes, it has been believed that in the infusibilization of mesophase pitch fibers under a $NO_2$-containing atmosphere, the oxidation reaction of the mesophase pitch fibers does not proceed efficiently at a temperature of lower than 150° C., and if the oxidation temperature is lower than 150° C., carbon fibers having sufficient strength and elastic modulus cannot be obtained.

However, the present inventors have found that infusibilization of the mesophase pitch fibers surprisingly proceeds sufficiently even at a low temperature of not higher than 100° C. in an atmosphere of an oxygen-containing gas such as air or an inert gas containing 0.1 to 50% by volume of $NO_2$, and also found that carbon fibers excellent in both mechanical strength and elastic modulus can be obtained.

The present invention is accomplished on the basis of the following finding. Namely, it has been conventionally thought that hydroxyl groups or carbonyl groups introduced by oxidation reaction to side chains of polycyclic aromatics of the pitch molecules are necessary in order to infusibilize the mesophase pitch, however, the present inventors have found a fact that the infusibilization of the mesophase pitch fibers sufficiently proceeds by suppressing this oxidation reaction and sufficiently introducing selectively nitro groups to the pitch molecules.

In the process of the present invention, moreover, since the mesophase pitch fibers are gas-phase nitrated at a low temperature, the pitch fibers can be efficiently infusibilized with keeping the orientation of pitch molecule for fiber axis given at the time of the mesophase pitch fiber-forming procedure. Therefore, physical properties of the resulting carbon fibers are not deteriorated to obtain uniform carbon fibers which are high in both the strength and the elastic modulus and have well-balanced physical properties.

In the process of the present invention, furthermore, the infusibilization is conducted at a low reaction temperature of not higher than 100° C. without generating any heat caused by oxidation, in contrast with a conventional infusibilization by means of air-oxidation, etc., and hence infusibilization of the pitch fibers in cans (vessels) of large capacity becomes possible, whereby a large amounts of pitch fibers can be efficiently infusibilized on an industrial scale.

A. Starting Pitch

The starting pitch comprising as its major component a mesophase pitch, which is used in the present invention, is prepared from a petroleum pitch or a coal pitch through various steps, such as, filtration, purifying, distillation, hydrogenation and catalytic cracking, in accordance with a conventional manner.

From the viewpoints of fiber physical properties, a mesophase pitch having a mesophase content of not less than about 70% is preferably used.

B. Mesophase Pitch Fibers

With respect to the shape of the mesophase pitch fibers used in the present invention, any of long fibers such as those to be wound around a bobbin or those to be taken into a can may be employed. Further, any of short fibers in various forms may be also employed.

The pitch fiber diameter is desirably small, for example, generally not more than 40 μm, preferably not more than 20 μm, because the gas-phase nitration reaction of the fibers can be efficiently performed owing to the large surface area.

In the preparation of the mesophase pitch fibers, any of conventionally known spinning methods can be adopted, as far as those methods are able to spin a mesophase pitch into fibers.

For example, a melt spinning method, a melt blow method, a spun bond method and a centrifugal spinning method are employable.

C. Infusibilization by Gas-Phase Nitration

The infusibilization of the mesophase pitch fibers by a gas-phase nitration thereof in the invention is required to be conducted in an atmosphere of an oxygen-containing gas such as air or an inert gas such as nitrogen containing 0.1 to 50% by volume of $NO_2$ at a low temperature of not higher than 100° C.

In the present invention, the mesophase pitch fibers are gas-phase nitrated at a low temperature of not higher than 100° C., preferably from room temperature to 100° C., more preferably from 60° to 95° C., so that introduction of carbonyl groups is suppressed and introduction of nitro groups are selectively performed. In contrast, the introduction of carboxyl groups is proceeded in the conventional oxidation reaction which is carried out at a high temperature of not lower than 150° C. As a result, in accordance with the present invention the pitch fibers become uniformly thermosetting, and the resulting carbon fibers have high physical properties.

The infusibilization of the mesophase pitch fibers by the gas-phase nitration thereof can be carried out at a temperature exceeding 100° C., for example, at about 130° C. However, if the gas-phase nitration reaction of the mesophase fibers is conducted at such high temperature, side chains of polycyclic aromatics and the like are oxidized, whereby uniform carbon fibers having high strength and high elastic modulus can be hardly obtained, as compared with the case where the gas-phase nitration reaction of the mesophase fibers is conducted at a temperature of not higher than 100° C.

The degree of the infusibilization by the gas-phase nitration in the invention corresponds with such factors as the $NO_2$ concentration in the gas phase, the treating temperature and the treating time, so that these conditions cannot be decided indiscriminately. In general, however, the infusibilization is desirably carried out at a $NO_2$ concentration in an oxygen-containing gas (e.g., air) or in an inert gas (e.g., nitrogen) of from 0.1 to 50% by volume, preferably from 1 to 30% by volume, more preferably from 1 to 10% by volume, particularly preferably from 2 to 5% by volume, at a reaction temperature of not higher than 100° C., preferably from room temperature to 100° C., more preferably from 60° to 95° C., for a reaction time of not shorter than 2 hours, preferably from 2 to 30 hours, more preferably from 4 to 12 hours.

When the infusibilization is carried out under these conditions, infusibilized mesophase pitch fibers are obtained in an yield of 110 to 130% by weight based on the amount of the starting mesophase pitch fibers.

If the $NO_2$ concentration in the oxygen-containing gas such as air or in the inert gas such as nitrogen is less than 0.1% by volume, the reaction rate of the nitration becomes extremely low, so that the aimed infusibilization by means of gas-phase nitration is unable to be expected.

Otherwise, even if the $NO_2$ concentration in the gas phase is so high as to exceed 50% by volume, further improvements of the physical properties caused by the nitration cannot be expected, though the gas-phase nitration reaction proceeds correspondingly to the concentration. Accordingly, 50% by volume is enough as the upper limit of the $NO_2$ concentration in the gas phase.

As the infusibilization atmosphere containing a specific amount of $NO_2$, any of gas atmospheres containing a specific amount of $NO_2$ can be employed without particular limitation, because $NO_2$ itself also functions as an oxidizing agent. However, desired is an atmosphere of an oxygen-containing gas such as air containing $NO_2$, an atmosphere of an inert gas such as nitrogen containing $NO_2$ or an atmosphere in which air is mixed with a given amount of an inert gas such as nitrogen containing $NO_2$.

In the invention, if necessary, a catalyst which serves to draw out hydrogen may be allowed to exist in the infusibilization atmosphere to accelerate the gas-phase nitration reaction.

As regards the apparatus and the method for practicing the gas-phase nitration in the invention, there can be adopted, for example, a method of continuously or separately introducing the mesophase pitch fibers into cans (vessels) of large capacity after the spinning operation and then infusibilizing them on a large scale in a chamber or the like.

D. Carbonization or Graphitization

The mesophase pitch fibers infusibilized by the gas-phase nitration as described above is then carbonized or graphitized in a conventional manner to produce carbon fibers or graphite fibers from the mesophase pitch.

There is no specific limitation on the carbonization or the graphitization as mentioned above, and the reaction conditions therefor can be appropriately determined according to the use of the resulting fibers. In general, the carbonization (or graphitization) of the infusibilized mesophase pitch fibers can be carried out by heating the infusibilized mesophase pitch fibers at a temperature of from 400° to 3,000° C., preferably from 900° to 2,500° C., at a heating rate of from 5° to 100° C./min, in an inert gas such as nitrogen or argon.

As mentioned before, the conventional infusibilization reaction of the mesophase pitch fibers by air-oxidation of the mesophase pitch fibers in a gas phase does not proceed at all when the temperature is not higher than 150° C.

If the temperature is as high as 200° to 400° C., the infusibilization of the mesophase pitch fibers by air-oxidation can be attained, but in this case, the molecular orientation in the infusibilized mesophase pitch thus obtained is lowered because the degree of the oxidation is relatively extreme. As a result, it is difficult to sufficiently grow the crystal structure of carbon atoms in the carbon fibers by the reason that the crystal growth of carbon atoms in the subsequent carbonization stage is inhibited, etc. Moreover, since the elimination of the introduced oxygen atoms during the carbonization stage results an occurrence of structural defect, it is difficult to obtain carbon fibers having high physical properties.

Further, if the infusibilization reaction is conducted at a temperature of not higher than 200° C., there is involved such a problem that the infusibilization reaction of the mesophase pitch fibers does not proceed uniformly sufficiently.

In addition, the conventionally known infusibilization reaction of the mesophase pitch fibers in $NO_2$-containing air is not thought to proceed unless the reaction temperature is as relatively high as not lower than 150° C.

If such infusibilization reaction of the mesophase pitch fibers is carried out at a high temperature of higher than 150° C., the degree of infusibilization may not become uniform similarly to the above-mentioned case of the infusibilization by the air-oxidation, though the degree of the heterogeneity is not so high as in the above-mentioned case, and as a result, carbon fibers having high physical properties can be hardly obtained.

According to the present invention, however, the mesophase pitch fibers are nitrated in the gas phase at a low temperature of not higher than 100° C., so that nitro groups are mainly and uniformly introduced into the fibers to obtain the thermosetting fibers. In the subsequent heat treatment for carbonizing and/or graphitizing the fibers, the intermolecular reaction takes place with an elimination of the nitro groups and polycondensation reaction proceeds, in accordance with the elevation of the temperature from approx. 180° C. As a result, homogeneous mesophase pitch based carbon fibers which are high in both the strength and the elastic modulus and have well-balanced physical properties can be obtained.

The present invention is described below in more detail with reference to examples, but it should be construed that the invention is in no way limited to those examples.

Example 1

A petroleum mesophase pitch (content of mesophase: 100%) having a softening point, as measured by a flow tester, of 300° C. was used as a starting material. This mesophase pitch was spun at a spinneret temperature of 330° C. and at a take-up rate of 300 m/min by a melt spinning method, to obtain mesophase pitch fibers [I] having a fiber diameter of 13 μm.

The mesophase pitch fibers [I] thus obtained were heated at 95° C. for 8 hours in air containing 2% by volume of $NO_2$, to obtain infusibilized mesophase pitch fibers. The yield of the infusibilized mesophase pitch fibers was 112.3% by weight.

Then, the infusibilized mesophase pitch fibers thus obtained were heated up to 1,500° C. at a heating rate of 30° C./min to carbonize the fibers so as to obtain carbon fibers. The yield of the carbon fibers was 91.2% by weight.

The physical properties of the carbon fibers obtained above are set forth in Table 1.

Example 2

The procedure of Example 1 was repeated except for varying the content of $NO_2$ to 10% by volume and varying the heating time at 95° C. to 4 hours, to prepare carbon fibers.

The physical properties of the carbon fibers thus obtained are set forth in Table 1.

Example 3

The procedure of Example 1 was repeated except for infusibilizing the mesophase pitch fibers in a nitrogen gas containing 10% by volume of $NO_2$ at 95° C. for 24 hours, to prepare carbon fibers.

The physical properties of the carbon fibers thus obtained are set forth in Table 1.

Comparative Example 1

The mesophase pitch fibers [I] obtained in Example 1 were heated from room temperature up to 300° C. at a heating rate of 3° C./min in air containing no $NO_2$, to obtain infusibilized mesophase pitch fibers.

The infusibilized mesophase pitch fibers thus obtained were carbonized in the same manner as described in Example 1 to prepare carbon fibers.

The physical properties of the carbon fibers are set forth in Table 1.

Comparative Example 2

The mesophase pitch fibers [I] obtained in Example 1 were heated at a temperature of 130° C. for 4 hours in air containing 10% by volume of $NO_2$, to obtain infusibilized mesophase pitch fibers.

The infusibilized mesophase pitch fibers thus obtained were carbonized in the same manner as described in Example 1 to prepare carbon fibers.

The physical properties of the carbon fibers are set forth in Table 1.

TABLE 1

| | Conditions for Infusibilization | | | | |
|---|---|---|---|---|---|
| | Concentration of $NO_2$ (vol. %) | Kind of Gas Atmosphere | Temperature (°C.) | Time (hr) | Yield (wt. %)*1 |
| Ex. 1 | 2.0 | air | 95 | 8 | 112.3 |
| Ex. 2 | 10.0 | air | 95 | 4 | 119.9 |
| Ex. 3 | 10.0 | nitrogen | 95 | 24 | 125.1 |
| Comp. Ex. 1 | 0 | air | 300*2 | — | 105.5 |
| Comp. Ex. 2 | 10.0 | air | 130 | 4 | 121.5 |

| | Conditions for Carbonization | | | Tensile Properties of Carbon Fibers | | |
|---|---|---|---|---|---|---|
| | Temperature Elevation Rate (°C./min) | Temperature (°C.) | Yield (wt. %)*1 | Fiber Diameter (μm) | Strength (kgf/mm²) | Elastic Modulus ($10^3$ × kgf/mm²) |
| Ex. 1 | 30 | 1,500 | 91.2 | 10.1 | 430 | 22.5 |
| Ex. 2 | 30 | 1,500 | 90.3 | 10.1 | 400 | 21.2 |
| Ex. 3 | 30 | 1,500 | 87.7 | 9.9 | 370 | 21.0 |
| Comp. Ex. 1 | 30 | 1,500 | 90.0 | 10.0 | 220 | 20.0 |
| Comp. Ex. 2 | 30 | 1,500 | 90.0 | 10.0 | 300 | 21.0 |

*1This yield is calculated when the weight of the mesophase pitch fibers is taken as 100.
*2The heating was conducted from room temperature up to 300° C. at a heating rate of 3° C./min.

Effect of the Invention

According to the present invention, infusibilization of the mesophase pitch fibers can be attained by gas-phase nitrating the mesophase pitch fibers in an oxygen-containing gas such as air or in an inert gas such as nitrogen, which contains a specific amount of $NO_2$, at a low temperature of not higher than 100° C. Moreover, homogeneous carbon fibers which are high in both the strength and the elastic modulus and have a good balance between these properties can be obtained.

If the mesophase pitch fibers are infusibilized in an oxygen-containing gas or inert gas atmosphere containing $No_2$ at a temperature of higher than 150° C. as suggested by the prior art techniques, the infusibilization is not carried out uniformly, and hence carbon fibers having well-balanced physical properties cannot be obtained.

What is claimed is:

1. A process for producing carbon fibers, comprising melt-spinning a mesophase pitch having a mesophase content of not less than about 70%, gas-phase nitrating the mesophase pitch fibers thus obtained in an oxygen-containing gas or inert gas atmosphere containing 0.1 to 50% by volume of $NO_2$ at a temperature of from 60° to 95° C. for a period of not shorter than 4 hours to infusibilize the pitch fibers, and subjecting the infusibilized pitch fibers to carbonizing or to carbonizing and graphitizing to obtain carbon fibers having a tensile strength of not less than 370 kgf/mm².

2. The process for producing carbon fibers as claimed in claim 1, wherein the mesophase pitch fibers are infusibilized in an oxygen-containing gas or inert gas atmosphere containing 1 to 10% by volume of $NO_2$.

* * * * *